US005282990A

United States Patent [19]

Yoneto et al.

[11] Patent Number: 5,282,990

[45] Date of Patent: Feb. 1, 1994

[54] SYNERGISTIC BLEND OF AMINE/AMIDE AND ESTER/ALCOHOL FRICTION MODIFYING AGENTS FOR IMPROVED FUEL ECONOMY OF AN INTERNAL COMBUSTION ENGINE

[75] Inventors: Yasuhiko Yoneto, Fujisawa, Japan; Ricardo Bloch, Scotch Plains, N.J.; Jack Ryer, E. Brunswick, N.J.; Harold E. Bachman, Summit, N.J.; Harold Shaub, Berkeley Heights, N.J.

[73] Assignee: Exxon Chemical Patents Inc., Linden, N.J.

[21] Appl. No.: 21,641

[22] Filed: Feb. 19, 1993

Related U.S. Application Data

[63] Continuation of Ser. No. 840,581, Feb. 24, 1992, abandoned, which is a continuation of Ser. No. 560,839, Jul. 31, 1990, abandoned.

[51] Int. Cl.[5] ..... C10M 125/00

[52] U.S. Cl. ..... 252/51.5 R; 252/51.5 A; 252/56 R

[58] Field of Search ..... 252/51.5 A, 51.5 R, 252/56 R

[56] References Cited

U.S. PATENT DOCUMENTS

| | | | |
|---|---|---|---|
| 2,623,887 | 5/1948 | Matuszak | 252/56 R |
| 2,721,879 | 10/1955 | Popkin | 252/56 R |
| 2,814,596 | 11/1957 | Whittleton | 252/56 R |
| 2,821,538 | 6/1958 | Dille | 252/56 R |
| 3,639,242 | 2/1972 | Le Suer | 252/56 R |
| 4,148,605 | 4/1979 | Andress, Jr. | 252/51.5 A |
| 4,194,985 | 5/1980 | Coleman | 252/51.5 A |
| 4,196,091 | 4/1980 | Schlicht | 252/51.5 A |
| 4,492,640 | 1/1985 | Horodysky et al. | |
| 4,492,642 | 1/1985 | Horodysky | |
| 4,512,903 | 4/1985 | Schlicht et al. | |
| 4,584,112 | 4/1986 | Erdman | |
| 4,670,173 | 6/1987 | Hayashi | 252/51.5 A |
| 4,743,389 | 5/1988 | Broid et al. | 252/51.5 A |
| 4,789,493 | 12/1988 | Horodysky | 252/51.5 A |
| 4,812,248 | 3/1989 | Marwick | 252/56 R |
| 4,816,171 | 3/1984 | Horodysky | 252/51.5 A |
| 4,832,860 | 5/1989 | Katafuchi et al. | 252/56 R |
| 4,921,624 | 5/1990 | Kammann | 252/51.5 A |
| 4,938,881 | 7/1990 | Ripple et al. | 252/51.5 A |

FOREIGN PATENT DOCUMENTS

| | | |
|---|---|---|
| 305538 | 2/1988 | European Pat. Off. |
| 0286996 | 10/1988 | European Pat. Off. |
| 335701 | 3/1989 | European Pat. Off. |
| 1390948 | 9/1963 | France |
| 2444706 | 12/1979 | France |
| 60-173097 | 9/1985 | Japan |
| 2034747 | 11/1979 | United Kingdom |
| 2034748 | 11/1979 | United Kingdom |
| 2097813 | 4/1982 | United Kingdom |

*Primary Examiner*—Stephen Kalafut
*Assistant Examiner*—M. Nuzzolillo
*Attorney, Agent, or Firm*—M. M. Allen

[57] ABSTRACT

The fuel economy of an internal combustion engine can be improved by adding to the lubricating oil used to lubricate the crankcase of said engine a synergistic blend of amine/amide and ester/alcohol friction modifying agents, for example, by reacting (a) a carboxylic acid, such as oleic acid and/or isostearic acid with an amine, such as diethylene triamine or tetraethylene pentamine, and (b) glycerine monooleate and/or glycerine monoricinoleate.

43 Claims, 1 Drawing Sheet

SYNERGISTIC BLEND OF AMINE/AMIDE AND ESTER/ALCOHOL FRICTION MODIFYING AGENTS FOR IMPROVED FUEL ECONOMY OF AN INTERNAL COMBUSTION ENGINE

This is a continuation of application Ser. No. 840,581, filed Feb. 24, 1992, now abandoned which is a continuation of U.S. Ser. No. 560,839, filed Jul. 31, 1990, which is now abandoned.

BACKGROUND OF THE INVENTION

1. Field of the invention

This invention relates to a method for improving the fuel economy of an internal combustion engine, and to a synergistic blend of friction modifiers which may be added to the crankcase lubricating oil of an internal combustion engine for accomplishing such result. The synergistic blend of friction modifiers comprises the combination of (a) an amine/amide friction modifier formed, for example, by reacting a carboxylic acid, such as oleic acid and/or isostearic acid with an amine, such as diethylene triamine or tetraethylene pentamine, and (b) an ester./alcohol friction modifier such as glycerine monooleate and/or glycerine monoricinoleate. The enhanced friction reduction achieved by the use of the synergistic blend of friction modifiers allows the formulation of engine lubricants which meet Tier II fuel economy.

2. Discussion on the Prior Art

The constant threat of diminishing sources of fossil fuels and the resulting increases in prices for such fuels, coupled with the federally mandated requirements for reducing the amount of toxic emissions spewed into the atmosphere, has resulted in a great deal of interest in improving fuel economy, particularly the fuel economy of automobile combustion engines.

Such interest has lead to the discovery of cleaner burning compositions, as well as to the discovery of a variety of fuel and/or engine lubricating oil compositions which result in improved fuel economy, that is a higher number of miles obtained in a given vehicle per gallon of fuel.

One such discovery, which is described in U.S. Pat. No. 4,584,112, involves lubricating the crankcase of an internal combustion engine with a lubricating oil composition consisting essentially of a hydrocarbon oil of lubricating viscosity, from 15 to 25 millimoles per kilogram of zinc O,O-di(2-ethylhexyl) phosphorodithoate, and from 0.25 to 2 wt. % of pentaerythritol monooleate.

U.S. Pat. Nos. 4,492,640 and 4,492,642 also describe methods for reducing the fuel consumption in internal combustion systems. Both of these patents described the addition to lubricating and/or fuel compositions used in an internal combustion engine of a friction reducing compound. The friction reducing compound disclosed in U.S. Pat. No. 4,492,640 comprises a boron derivative of a mixture of alkoxylated alcohols and hydroxy sulfides, whereas the friction reducing compound disclosed in U.S. Pat. No. 4,492,642 comprises the product formed by reacting a borating agent with an ammoniated hydrocarbyl epoxide.

U.S. Pat. No. 4,512,903 discloses lubricating compositions which contain still other friction reducing compounds, namely, amides prepared from mono-or polyhydroxy-substituted aliphatic monocarboxylic acids and primary or secondary amines.

The use of a lubricating oil composition comprising a base oil and a friction modifier in an automatic transmission or a continuously variable transmission, or as a lubricating oil for use in parts including wet clutches or a wet brake of an agricultural tractor is described in European Application 286,996. The friction modifying compounds used in the lubricating oil compositions of that European application are said to include such friction modifiers as phosphoric acid esters, phosphorus acid esters, amine salts of phosphoric acid esters, amine salts of phosphorus acid esters, sorbitan fatty acid esters, pentaerythritol fatty acid esters, glycerine fatty acid esters, trimethylolpropane fatty acid esters, glycol fatty acid esters, carboxylic acids, carboxylic acid amides, carboxylic acid esters, metal salts of carboxylic acids, fats and oils, higher alcohols and sulfur-containing compounds. The numerous disclosed friction modifiers can be used alone or in combination with one another. This European application states that the lubricating oil compositions exhibit excellent frictional characteristics, which change little with time and which are characterized by excellent stability against oxidation. However, there is no suggestion of using the disclosed lubricating oil compositions as a crankcase lubricant, nor is there any discussion of any possible effect on fuel economy.

A similar disclosure is contained in Japanese Kokai 60-173097. This Japanese publication discloses lubricating oil compositions which are useful in automatic transmissions and which comprise a base oil and a friction modifier. The lubricating oil compositions exhibit high stability against oxidation and change of properties with time, exhibit low shift shock and high transmission torque, and anticorrosive qualities. The friction modifiers which are disclosed in the Japanese publication this document include phosphoric acid esters, phosphorus acid esters or an amine salt thereof; a fatty acid ester of sorbitan, pentaerythritol, glycerine, trimethylolpropane or a glycol; a carboxylic acid or an amide, ester or metal salt thereof; and fats or oils, higher alcohols or sulfur-containing compounds. There is no discussion in the Japanese publication of the possibility of adding the lubricating oil compositions to a crankcase of an internal combustion engine, nor is there any discussion of fuel economy.

SUMMARY OF THE INVENTION

Figure 1:
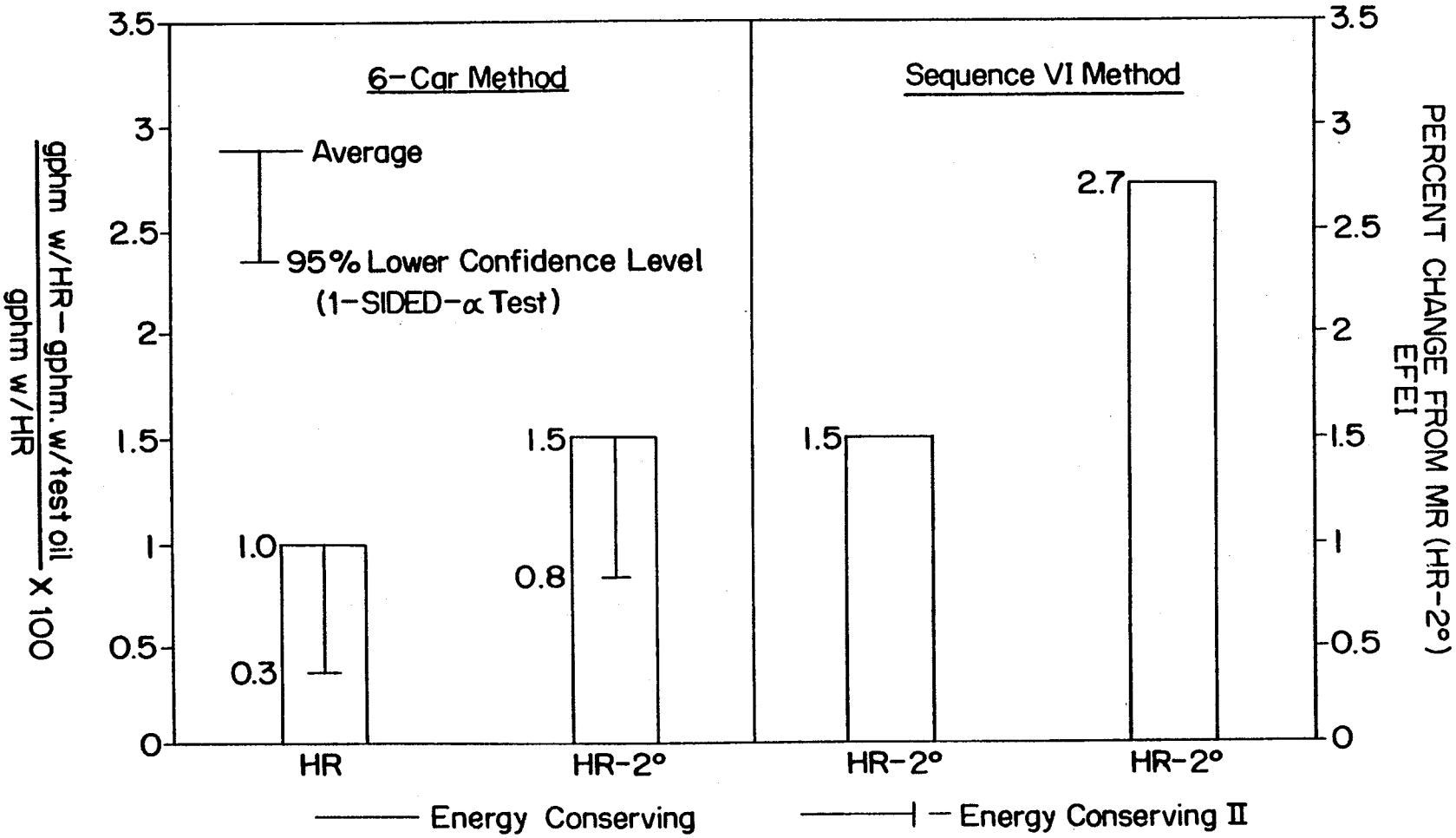
FIG. 1 is a graphical representation of percent change in efficiency obtained using an Energy Conserving oil or an Energy Conserving II oil as compared to using a reference HR oil.

It now has been found that if 0.01 to about 2.0 wt. % of an amine/amide, such as the reaction product of a fatty acid (e.g., isostearic acid) and tetra-ethylene pentamine in combination with about 0.01 to about 2.0 wt. % of an ester/alcohol, such as glycerine monooleate, is added to an otherwise standard lubricating oil composition that is used to lubricate the crankcase of an internal combustion engine, a measurable improvement in fuel economy is accomplished.

Thus, in accordance with the invention, there is provided a crankcase lubricating oil composition comprising an oil of lubricating viscosity and a synergistic blend of at least one compound (A) prepared by reacting an acid or a mixture of acids with a polyamine and at least one compound (B) prepared by reacting an acid or a mixture of acids with a polyol.

The invention also provides a lubricant additive concentrate comprising a lubricant oil and a synergistic blend of amine/amide and ester/alcohol friction modifying agents. It is further contemplated that the synergistic blend of friction modifying agents will aid in the reduction of fuel consumption in an internal combustion engine. Accordingly, the invention provides a method of improving the fuel economy of an internal engine which comprises adding to the crankcase of such engine a lubricant composition containing the herein described synergistic blend of friction modifying agents.

DESCRIPTION OF SPECIFIC EMBODIMENTS

As has been mentioned above, the synergistic blend of friction modifying agents in accordance with the invention comprises (A) an amine/amide friction modifier and (B) an ester./alcohol friction modifier.

The amine/amide friction modifier can be prepared by reacting an acid or a mixture of acids with a polyamine or mixture thereof. The acids which are suitable for reaction with the polyamine include fatty acids having from about 6 to about 36 total carbon atoms, typically from about 7 to about 24 carbon atoms, and preferably from about 14 to about 20 carbon atoms. The acids may be linear or branched, and may be saturated or unsaturated. Dimer cards such as linoleic acid dimer are also useful.

Non-limiting examples of suitable acids for reaction with the polyamine include: butyric acid, isovaleric acid, caproic acid, heptanoic acid, 2-ethyl hexanoic acid, caprylic acid, pelargonic acid, capric acid, lauric acid, myristic acid, palmitic acid, eicosoic acid, stearic acid, isostearic acid, oleic acid, linoleic acid, ricinoleic acid, behenic acid, erucic acid, behenolic acid, linoleic acid dimer, coconut oil fatty acid, palm kernel oil fatty acid, tall oil fatty acid, and the like, and mixtures thereof. The preferred acid or mixture of acids should have an average from about 7 to about 24, and more preferably from about 14 to about 20, total carbon atoms.

The use of hydroxy fatty acids, such as ricinoleic acid, has been found to be particularly preferred. While the reasons for the exceptional performance characteristics that have been achieved when using a hydroxy fatty acid in preparing the amine/amide and ester/alcohol friction modifiers of the present invention is not completely understood, it is believed that by virtue of one or more hydroxy groups along the carbon chain of the hydroxy fatty acid portion of the friction modifier, there is better cohesion between adjacent molecules of the friction modifiers and, thus, more effective boundary lubrication.

The amines which are useful for reaction with the above acids to form the amine/amide friction modifiers include polyamines or mixtures of polyamines. Typically, the polyamines will have from about 2 to about 60, and preferably from 3 to about 10, total carbon atoms in the molecule. The useful amines generally will contain from about 2 to about 20 total nitrogen atoms, typically from about 2 to about 14, and preferably from 2 to about 12 nitrogen atoms per molecule. These amines may be hydrocarbyl amines or may be hydrocarbyl amines including other non-interfering groups, e.g., alkoxy groups, amide groups, nitrile groups, imidazoline groups, and the like. Preferred amines are aliphatic saturated amines, including those of the general formula:

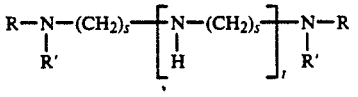

(I)

wherein R and R' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; and $C_1$ to $C_{12}$ alkylamino $C_2$ to $C_6$ alkylene radicals; each s is the same or a different number of from 2 to 6, preferably 2 to 4; and t is a number of from 0 to 10, preferably 2 to 7. If t=0, then at least one of R or R' must be H such that there are at least two of either primary or secondary amino groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene) triamine; N,N-dimethyl-1,3-diamino-propane; N,N-di-(2-aminoethyl) ethylene diamine; N-dodecyl-1,3-propane diamine; di-,and tri-tallow amines; amino morpholines such as N-(3-aminoproply) morpholine; etc.

Other useful amine compounds include: alicyclic diamines such as 1,4-di(aminomethyl) cyclohexane, and heterocyclic compounds such as morpholines, imidazolines, and N-aminolakyl piperazines of the general formula:

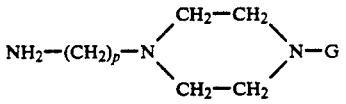

(II)

wherein G is independently selected from the group consisting of hydrogen and omega-(non-tertiary) aminoalkylene radicals of from 1 to 3 carbon atoms, and p is a number of from 1 to 4. Non-limiting examples of such amines include 2-pentadecyl imidazoline; N-(2-aminoethyl) piperazine; etc.

Commercial mixtures of amine compounds advantageously may be used. For example, one process for preparing alkylene amines involves the reaction of an alkylene dihalide (such as ethylene dichloride or propylene dichloride ) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. A low cost mixture of poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxalkylene polyamines such as those of the formulas:

$$NH_2\text{-alkylene-(O-alkylene)-}_mNH_2 \quad \text{(III)}$$

where m has a value of about 3 to 70 and preferably 10 to 35; and $$R\text{-[alkylene-(O—alkylene)}_n\text{NH}_2]_a \quad \text{(IV)}$$

where n has a value of about 1 to 40 with the proviso that the sum of all the n's is from about 3 to about 70 and preferably from about 6 to about 35, R is a polyvalent saturated hydrocarbon radical of up to ten carbon atoms, and a is a number from 3 to 6. The alkylene groups in either formula III or IV may be straight or branched chain containing about 2 to 7, and preferably about 2 to 4 carbon atoms.

The above polyoxyalkylene polyamines, preferably polyoxyalkylene diamines and polyoxyalkylene triamines, may have average molecular weights ranging from about 200 to about 4,000 and preferably from about 400 to about 2,000. The preferred polyoxyalkylene polyamines include the polyoxyethylene and polyoxypropylene diamines and the polyoxypropylene triamines having average molecular weight ranging from about 200 to 2,000. The polyoxyalkylene polyamines are commercially available and may be obtained, for example, from the Jefferson Chemical Company, Inc. under the trade name "Jeffamines D-230, D-400, D-1000, D-2000, T-403", etc.

Still other useful amines are those which can be generalized by the formula $$NH_2\text{-}Z\text{-}NH_2 \qquad (V)$$

where Z may be $—CH_2CH_2CH_2—$, $—(CH_2CH_2CH_2NH)_nCH_2CH_2CH_2—$, where n is 1–6, or $\text{-}(CH_2CH_2CH_2NH)_mCH_2(CH_2)p(NH—CH_2CH_2CH_2)_{m'}\text{-}$, where m and m' are each at least 1 and m +m' is 2–5, p is 1–4.

Further amines include polyamino propyl amines having C-substituents such as $C_{12}$–$C_{20}$ alkyl, $C_6$–$C_{10}$ aryl, hydroxyl, thiol, cyano, ethoxy, polyoxyethylene and polyoxypropylene having a degree of polymerization of 2–10 and other compatible non-reactive functional groups, but N-substituted polyamines are not suitable reactants in preparing macrocyclic compounds in a cyclodehydration reaction, i.e. the nitrogen atoms must be either —NH or $—NH_2$. Preferably Z is $—CH_2CH_2CH_2—$, $—(CH_2CH_2CH_2NH)_nCH_2CH_2CH_2—$ where n is 1–3, or $—(CH_2CH_2CH_2NH)_m(CH_2CH_2)(NHCH_2CH_2CH_2)_{m'}—$, where m and m' are as described above.

The amine is readily reacted with the acid material, e.g. oleic acid by heating an oil solution containing 10 to 95 wt. % of acid material to about 160 to 200° C., preferably 180° to 190° C., generally for 2 to 6, e.g. 3 to 5 hours until the desired amount of water is removed.

While the amine may used in any amount effective to form an amide from the acid material, generally the amine and acid are contacted in an acid amine equivalent ratio of from about 1:10 to 1:1, preferably from about 1:4 to 2:3.

The ester/alcohol friction modifiers may be prepared by reacting an acid or mixture of acids with a polyol or mixture thereof. The acids suitable for use include those acids described hereinabove.

The polyols contemplated for use in this invention include aliphatic polyhydric alcohols containing up to about 100 carbon atoms and about 2 to about 10 hydroxyl groups. These alcohols can be quite diverse in structure and chemical composition, for example, they can be substituted or unsubstituted, hindered or unhindered, branched chain or straight chain, etc. as desired. Typical alcohols are alkylene glycols such as ethylene glycol, propylene glycol, trimethylene glycol, butylene glycol, and polyglycol such as diethylene glycol, triethylene glycol, tetraethylene glycol, dipropylene glycol, tripropylene glycol, dibutylene glycol, tributylene glycol, and other alkylene glycols and polyalkylene glycols in which the alkylene radical contains from two to about eight carbon atoms. Other useful polyhydric alcohols include glycerol, monomethyl ether of glycerol, pentaerythritol, dipentaerythritol, tripentaery-thritol, 9,10-dihydroxystearic acid, the ethyl ester of 9,10-dihydroxystearic acid, 3-chloro-1, 2-propanediol, 1,2 butanediol, 1,4-butanediol, 2,3-hexanediol, 2,3-hexanediol, pinacol, tetrahydroxy pentane, erythritol, arabitol, sorbitol, mannitol, 1,2-cyclohexanediol, 1,4-cyclohexanediol, 1,4-(2-hydroxyethyl)-cyclohexane, 1,4-dihydroxy-2-nitro-butane, 1,4-di-(2-hydroxyethyl)-benzene, the carbohydrates such as glucose, rhamnose, mannose, glyceraldehyde, and galactose, and the like, amino alcohols such as di(2-hydroxyethyl)amine, tri-(3-hydroxypropyl)amine, N,N'-di-(hydroxyethyl)-ethylenediamine, copolymer of allyl alcohol and styrene, N,N-di-(2-hydroxylethyl) glycine and esters thereof with lower mono-and polyhydric aliphatic alcohols etc.

Included within the group of aliphatic alcohols are those alkane polyols which contain ether groups such as polyethylene oxide repeating units, as well as those polyhydric alcohols containing at least three hydroxyl groups, at least one of which has been esterified with a mono-carboxylic acid having from eight to about 30 carbon atoms such as octanoic acid, oleic acid, stearic acid, linoleic acid, dodecanoic acid, or tall oil acid, Examples of such partially esterified polyhydric alcohols are the mono-oleate of sorbitol, the mono-oleate of glycerol, the mono-stearate of glycerol, the di-stearate of sorbitol, and the di-dodecanoate of erythritol.

Also included among the alcohols which may be used in the invention are containing nitrogen or sulfur such as the thiobisethanols and amino-alcohols.

Useful amino alcohol compounds include 2,2-disubstituted-2-amino-1-alkanols having from two to three hydroxyl group sand containing a total of 4 to 8 carbon atoms. This amino alcohol can be represented by the formula:

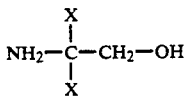

(VI)

wherein X is an alkyl or hydroxyalkyl group with the alkyl groups having from 1 to 3 carbon atoms wherein at least one, and preferably both, of the X substituents is a hydroxyalkyl group of the structure $(CH_2)_nOH$, n being 1 to 3, Examples of such amino alcohols include: 2-amino-2-methyl-1,3 propanediol; 2-amino-2-ethyl-1,3-propanediol; and 2-amino-2-(hydroxymethyl)-1,3-propanediol, the latter also being known as THAM, or tris (hydroxymethyl) amino methane. THAM is particularly preferred because of its effectiveness, availability and low costs.

A preferred class of ester intermediates are those prepared from aliphatic alcohols containing up to 20 carbon atoms, and especially those containing three to 15 carbon atoms. This class of alcohols includes glycerol, erythritol, pentaerythritol, dipentaerythritol, tripentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl)-cyclohexanol, 1,10-decanediol, digitalose, and the like. The esters prepared from aliphatic alcohols containing at least three hydroxyl groups and up to fifteen carbon atoms are particularly preferred.

An especially preferred class of polyhydric alcohols for preparing the ester/alcohol friction reducing agents used in the present invention are the polyhydric alkanols containing 3 to 15, especially 3 to 6 carbon atoms and having at least 3 hydroxyl groups. Such alcohols are exemplified in the above specifically identified alcohols and are represented by glycerol, erythritol, pentaerythritol, mannitol, sorbitol, 1,2,4-hexanetriol, and tetrahydroxy pentane and the like.

The polyol component is readily reacted with the acid component, e.g. ricinoleic acid or oleic acid, by heating a mixture of the polyol and acid in a reaction vessel in the absence of a solvent at a temperature of about 130° C. to about 180° C., typically about 140° C. to about 160° C., and preferably at about 145° C. to about 150° C., for a sufficient period of time to effect reaction, typically from about 4 to about 6 hours. Optionally, a solvent for the acid, polyol and/or the resulting ester/alcohol product may be employed to control viscosity and/or the reaction rates.

The acids that are suitable for reaction with the polyol component to prepare the ester/alcohol products that are usable in the present invention are the same acids that have been described above in connection with the amine/amide friction modifiers.

In one preferred embodiment of the invention, the acid, e.g. oleic and or more preferably, a hydroxy acid such as ricinoleic acid, is reacted with a polyol, e.g., glycerol, in a 2:1 mole ratio of acid to glycerol. In practice, the ratio of acid to polyol may vary. For example, the mole ratio of acid to polyol may vary from about 3:1 to about 1:1. As is the case with the acid/polyamine adducts, it is necessary to maintain an excess of acid in the reaction mixture on a molar basis.

THE COMPOSITIONS

The amine/amide and ester/alcohol friction modifier blend of the present invention, when added to an oil of lubricating viscosity, have been found to impart exceptionally good friction reduction properties, as measured in terms of fuel economy of internal combustion engines having had their crankcases lubricated with such oil compositions.

Accordingly, the synergistic blends of friction modifiers contemplated by this invention are used by incorporation and dissolution into an oleaginous material such as internal engine crankcase lubricating oil formulations which employ a base oil in which the various additives are dissolved or dispersed.

Base oils suitable for use in preparing lubricating compositions of the present invention include those conventionally employed as crankcase lubricating oils for spark-ignited and compression-ignited internal combustion engines, such as automobile and truck engines, marine and railroad diesel engines, and the like. Such base oils may be natural or synthetic although the natural base oils will derive a greater benefit.

Thus, the synergistic blend of additives of the present invention suitably may be incorporated into synthetic base oils such as alkyl esters of dicarboxylic acids, polyglycols and alcohols, polyalphaolefins, alkyl benzenes, organic esters of phosphoric acids, polysilicone oils, etc.

Natural base oils include mineral lubricating oils which may vary widely as to their crude source, e.g., whether paraffinic, naphthenic, mixed, paraffinic-naphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, molecular sieves, etc.

The lubricating oil base stock conveniently has a viscosity of typically about 2.5 to about 12, and preferably about 2.5 to about 9 cs. at 100° C.

Thus, the herein contemplated blend of friction modifying agents can be employed in a lubricating oil composition which comprises lubricating oil, typically in a major amount, i.e., greater than 50 wt.%, and the blend of friction modifiers, typically in a minor amount, i.e., less than 50 wt.%, which is effective to impart unexpectedly enhanced friction reduction properties, relative to the absence of the subject friction modifying additives. Additional conventional additives selected to meet the particular requirements of a selected type of lubricating oil composition can be included as desired.

The friction modifying additives of this invention are oil-soluble, dissolvable in oil with the aid of a suitable solvent, or are stably dispersible in oils. Oil-soluble, dissolvable or stably dispersible as that terminology is used herein does not necessarily indicate that the materials are soluble, dissolvable, miscible, or capable of being suspended in oil in all proportions. It does mean, however, that the friction modifying additives, for instance, are soluble or stably dispersible in oil to an extent sufficient to exert their intended effect in the environment in which the oil is employed. Moreover, the additional incorporation of other additives may also permit incorporation of higher levels of a particular friction modifier, if desired.

Accordingly, while any effective amount of the amine/amide and ester/alcohol friction modifier additives can be incorporated into the lubricating oil composition, it is contemplated that such effective amount be sufficient to provide said lube oil composition with an amount of the amine/amide friction modifier additive of typically from about 0.01 to about 2, and preferably from about 0.2 to about 0.5 wt.%, based on the weight of said composition, and with an amount of ester/alcohol friction modifier additive typically from about 0.01 to 2, and preferably from about 0.2 to about 0.5 wt.% . It is also contemplated that the weight ratio of the amine/amide friction modifier to the ester/alcohol friction modifier typically will be from about 1:10 to 10:1, and preferably from about 1:2 to 2:1.

The friction modifier additives of the present invention can be incorporated into the lubricating oil in any convenient way. Thus, they can be added directly to the oil by dispersing, or dissolving the same in the oil at the desired level of concentration typically with the aid of a suitable solvent such as toluene, or tetrahydrofuran. Such blending can occur at room temperature or elevated temperatures. Alternatively, the friction modifier additives may be blended with a suitable oil-soluble solvent and base oil to form a concentrate, and then blending the concentrate with lubricating oil base stock to obtain the final formulation. Concentrates will typically contain from about 20 to about 80 wt.%, and preferably about 20 to about 60 wt.%, by weight of the blended friction modifier additives, and typically from about 80 to about 20%, preferably from about 60 to about 20% by weight base oil, based on the concentrate weight.

The lubricating oil base stock for the friction modifier additive blend of the present invention typically is adapted to perform a selected function by the incorporation of additives therein to form lubricating oil compositions (i.e., formulations).

Representative additives typically present in such formulations include dispersants, viscosity modifiers, corrosion inhibitors, oxidation inhibitors, other friction modifiers, anti-foaming agents, anti-wear agents, pour point depressants and the like.

Viscosity modifiers impart high and low temperature operability to the lubricating oil and permit it to remain shear stable at elevated temperatures and also exhibit acceptable viscosity or fluidity at low temperatures.

Viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have number average molecular weights of from $10^3$ to $10^6$, preferably $10^4$ to $10^6$, e.g., 20,000 to 250,000, as determined by gel permeation chromatography or membrane osmometry.

Representative examples of suitable viscosity modifiers are any of the types known to the art including polyisobutylene, copolymers of ethylene and propylene, polymethacrylates, methacrylate copolymers, copolymers of an unsaturated dicarboxylic acid and vinyl compound and interpolymers of styrene and acrylic esters.

Corrosion inhibitors, also known as anti-corrosive agents, reduce the degradation of the metallic parts contacted by the lubricating oil composition. Illustrative of corrosion inhibitors are zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt.% of a sulfide of phosphorus for ½ to 15 hours, at a temperature in the range of 65° to 320° F. Neutralization of the phosphosulfurized hydrocarbon may be effected in the manner taught in U.S. Pat. No. 1,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenolthioesters having preferably $C_5$ to $C_{12}$ alkyl side chains, e.g., calcium nonylphenol sulfide, barium t-octylphenyl sulfide, dioctylphenylamine, phenylalphanaphthylamine, phosphosulfurized or sulfurized hydrocarbons, etc.

Representative examples of suitable additional friction modifiers which may be added to the lubricating oil formulations are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U. S. Pat. No.33,778,375 which discloses reaction products of a phosphonate with an oleamide; U. S. Pat. No. 3,852,205 which discloses S-carboxyalkylene hydrocarbyl succinimide, S-carboxyalkylene hydrocarbyl succinamic acid and mixtures thereof; U. S. Pat. No. 3,879,306 which discloses N-(hydroxyalkyl)alkenyl-succinamic acids or succinimides; U. S. Pat. No. 3,932,290 which discloses reaction products of di-(lower alkyl) phosphites and epoxides; and U. S. Pat. No. 4,028,258 which discloses the alkylene oxide adduct of phosphosulfurized N -( hydroxyalkyl) alkenyl succinimides. The disclosures of the above references are herein incorporated by reference. The most preferred friction modifiers to be used in combination with the blend of amide/amine and ester/alcohol friction modifier of the present invention are succinate esters, or metal salts thereof, of hydrocarbyl substituted succinic acids or anhydrides and thiobis alkanols such as described in U. S. Pat. No. 4,344,853, disclosure of this patent also being herein incorporated by reference.

Dispersants maintain oil insolubles, resulting from oxidation during use, in suspension in the fluid thus preventing sludge flocculation and precipitation or deposition on metal parts. Suitable dispersants include high molecular weight polyalkenyl succinimides, e.g., the reaction product of oil-soluble polyiso-butylene succinic anhydride with ethylene amines such as tetraethylene pentamine and borated salts thereof.

Pour point depressants lower the temperature at which the fluid will flow or can be poured. Such depressants are well known. Typically of those additives which usefully optimize the low temperature fluidity of the fluid are $C_8$–$C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate, zinc diaryldithiosphate and magnesium sulfonate.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | Vol % | Wt % |
|---|---|---|
| Viscosity Modifier | 0.01 | 1-4 |
| Corrosion Inhibitor | 0.01-1 | 0.01-1.5 |
| Oxidation inhibitor | 0.01-1 | 0.01-1.5 |

-continued

| Additive | Vol % | Wt % |
|---|---|---|
| Dispersant | 0.1-7 | 0.1-8 |
| Pour Point Dispersant | 0.01-1 | 0.01-1.5 |
| Detergents/Rust Inhibitors | 0.01-2.5 | 0.01-3 |
| Anti-Foaming Agents | 0.001-0.1 | 0.001-0.15 |
| Anti-Wear Agents | 0.001-1 | 0.001-1.5 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the friction modifier blend (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the blend of friction modifier additives and optional additional additives in proper amounts to provide the desired concentration in the final formulation when the additive-package is combined with a predetermined amount of base lubricant. Thus, the blend of friction modifier additives of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt.% of the additive-package with the remainder being base oil.

All of said weight percents expressed herein are based on active ingredient (A.I.) content of the additive, and/or upon the total weight of any additive-package, or formulation which will be the sum of the A.I. weight of each additive plus the weight of total oil or diluent.

This invention will be further understood by reference to the following examples, wherein all parts are parts by weight and all molecular weights are number average molecular weights unless otherwise noted, and which include preferred embodiments of the invention.

EXAMPLE 1

Preparation of amine/amide friction modifier

Approximately 847 grams (3 moles) of oleic acid and 189 grams (1 mole) of tetraethylene pentamines (TEPA) were charged to a reaction flask. The mixture was then heated under an inert ($N_2$) atmosphere to about 190° C., removing water by distillation. After about 20 hours, the reaction appeared to be complete, and the reaction mixture was cooled and filtered. The reaction product comprised an oleic acid-TEPA friction modifying agent and was found to have a total acid number (TAN) of about 6.0.

Samples of a lubricating oil formulation containing a friction modifier blend prepared in accordance with this invention were subjected to a standard ball-on cylinder test. Similar samples formulations containing either no friction modifier or friction modifiers outside the scope of this invention were also tested.

The ball-on cylinder (BOC) test, which forecasts the friction performance of a given oil formulation, is described in : W. E. Waddey, H. Shaub, J. M. Pecorard, and R. A. Carley, "Improved Fuel Economy Via Engine Oils", SAE Paper no. 780,599 (1978).

This test examines steel-steel boundary lubrication in terms of friction coefficient. It has been applied as a 'first stage' screening tool for fuel-efficient engine oil (FEED) selection. The BOC conditions are believed to represent 'pure' boundary-friction (BL). It's use in screening FEED's is described in: TF Lonstrup, H. E. Bacheran, and C. R. Smith, "Testing the Fuel Economy Characteristics of Engine Oils," SAE Paper no. 790,949 (1979).

The BOC device consists basically of a rotating chrome steel cylinder to which is held a stationary steel ball at a fixed normal load. The cylinder is partly immersed in the test oil which distributes over the surface of the cylinder. The restraining force on the steel ball is measured by a linear variable differential transformer (LVDT) and recorded on a strip-chart. The cylinder wear tracks's cross-section is later examined with a surface profilometer.

BOC test conditions/parameters:

AISI 52100 alloy steel ball of Rockwell hardness of 62-64

AISI 52100 alloy steel cylinder of Rockwell hardness of 20 turning speed of cylinder-approximately 0.26 wet air is bubbled into the lubricant reservoir applied load on cylinder—4 kg lubricant temperature-120° C.

test time—50 minutes

1 = boundary friction coefficient: u = drag force normal load BL does not depend on bulk lubricant viscosity; instead BL is controlled by chemical properties of the lubricant and the metal's surface (beilby layer)

The base oil formulation used in the ball-on cylinder tests was an SG/Tier 1 10W30 crankcase lubricating oil formulation containing only a refined base mineral oil, a dispersant, viscosity index improver, a pour point depressant and a zinc dialkyldithiophosphate anti-wear additive. To this base formulation, there was added either no friction modifier (control), 0.1 wt. % of Loxiol G11 (a glycerine monoricinoleate friction modifier marketed by Henkel Corporation; Comparative Formulation 1), 0.2 wt.% of a glycerine mono- and dioleate friction modifier (Comparative Formulation 2), 0.2 wt. % of the oleic acid/TEPA friction modifier of EXAMPLE 1 (Comparative Formulation 3), a blend of 0.2 wt.% of glycerine mono-and dioleate and 0.2 wt.% o the oleic acid/TEPA of EXAMPLE 1 (Formulation 4), a blend of 0.1 wt.% of Loxiol G11, 0.2 Wt.% glycerine mono- and dioleate and 0.2 wt. % of oleic acid/TEPA (Formulation 5), a blend of 0.1 wt.% Loxiol G11 and 0.2 wt. % of oleic acid/TEPA (Formulation 6), or a blend of 0.1 wt. % Loxiol G11 and 0.2 wt.% glycerine mono- and dioleate (Comparison Formulation 7).

The ball-on cylinder test was conducted at 120° C. for a duration of 50 minutes and the results for each formulation was observed. At the initial stage of the tests (8-16 minutes) Formulations 4, 5 and 6 showed significant effect in friction reduction. At the second stage (16-32 minutes) Comparative Formulation 1 also showed strong friction reducing effect, in addition to formulations 4, 5 and 6. The overall test duration indicated a significant synergistic effect on friction reduction with Loxiol G11 and oleic acid/TEPA (Formulation 6), with the greatest reduction in friction being observed with the system containing the three friction modifiers Loxiol G11, glycerine mono- and dioleate, and oleic acid/TEPA (Formulation 5).

Based on the above results, a standard ASTM Sequence VI test was run for comparative Formulation 1, for Comparative Formulation 6, and for Formulation 5.

The Sequence VI test procedure (SAE JI 423 May 1988) is used for evaluating engine oils and for identifying energy conserving engine oils for passenger cars, vans, and light duty (8500 lbs GVW or less) trucks. The recommended practice (JI 423) involves a classification for engine oils that have energy-conserving characteristics under certain operating conditions and are categorized as "Energy Conserving" (tier I) or "Energy Conserving II" (tier II). In accordance with the definitions set forth in the Sequence VI test procedure (SAE JI 423 May 1988), Energy Conserving (tier I) and Energy Conserving II (tier II) engine oils are lubricants that demonstrate reduced fuel consumption when compared to specified ASTM reference oils using a procedure which is described in ASTM Research Report No. RR:PD02:1204, "Fuel Efficient Engine Oil Dynamometer Test Development Activities, Final Report, Part II, Aug. 1985."

The Sequence VI procedure compares fuel consumption with a candidate oil to that with the ASTM HR (High Reference) SAE 20W-30 Newtonian oil in terms of Equivalent Fuel Economy Improvement (EFEI) by use of the following equation:

$$EFEI = \frac{[0.65\ (\text{Stage } 150) + 0.35(\text{Stage } 275) - 0.61}{1.38}$$

The equation is used to transfer the data obtained in two stages of an older procedure, known as the five-car procedure (published as D-2 Proposal P101 in Volume 05.03 of the 1986 ASTM Book of Standards), which is an alternative method only for use in evaluating engine oils that meet the Energy Conserving (tier I) category. To fulfill the Tier I energy-conserving requirement using the five-car procedure, the candidate oil must meet the performance limits of the classification published as a proposal in Volume 05.03 of the ASTM Book of Standards (D-2 Proposal P102) and shown graphically in FIG. 1 herein. The five-car average fuel consumption with the candidate oil must be less than that with reference oil HR by at least 1% and the minimum lower 95% confidence level (LCL95) must be at least 0.3%. When using reference oil HR-2, the average fuel consumption with the candidate oil must be at least 1.5% less than that with reference oil with a minimum LCL95.

When the Sequence VI test is used, the results obtained in two of the stages of the test are transformed to an equivalent five-car percent improvement by use of the above equation.

The Equivalent Fuel Economy improvement (EFEI) from the Sequence VI test must meet the limits of the aforementioned classification D-2 Proposal P102, with the exception of the LCL95 requirement which applies to only the five-car procedure. For a candidate oil to be categorized as Energy Conserving II the Equivalent Fuel Economy Improvement (EFEI) as described above and as shown graphically in FIG. 1, must be a minimum of 2.7% when compared to HR-2.

Thus Engine oils categorized as "Energy Conserving, (tier I) are formulated to improve the fuel economy of passenger cars, vans and light-duty trucks by an EFEI of 1.5% or greater over a standard reference oil in a standard test procedure, whereas oils categorized as "Energy Conserving II" (tier II) are formulated to improve the fuel economy of passenger cars, vans and light-duty trucks by an EFEI of 2.7% or greater over a standard reference oil in a standard test procedures. Of course, the actual fuel economy obtained by individual vehicle operators using engine oils which are labeled "ENERGY CONSERVING" or "ENERGY CONSERVING II" may differ because of many factors including type of vehicle and engine, engine manufacturing variables, mechanical condition and maintenance of the engine, oil previously used, operating conditions, and driving habits.

The Sequence VI test resulted in an EFEI % of 2.47 for Comparative Formulation, 1, an EFEI % of 2.65 for Comparative Formulation 7, and an EFEI % of 2.86 for Formulation 5. Thus, it can be seen that blends of friction modifiers in accordance with the present invention can be used to achieve tier II fuel economy, i.e. an EFEI % of at least about 2.7.

As will be evident to those skilled in the art, various modifications of the invention can be made or followed, in light of the forgoing disclosure and illustrative examples, tables and discussion, without departing from the scope of the disclosure or from the scope of the invention as set forth in the following claims.

What is claimed is:

1. A blend of friction modifier additives adapted for use in combination with an oil of lubricating viscosity in the crankcase of a vehicle powered by an internal combustion engine to improve the fuel economy of said engine, comprising at least one amine/amide friction modifier and at least one ester/alcohol friction modifier, said blend having a weight ratio of amine/amide:ester/alcohol of from 1:10 to about 10:1, said amine/amide friction modifier having been prepared by reacting at least one linear or branched, saturated or unsaturated aliphatic carboxylic acid having from about 7 to about 24 total carbon atoms with at least one polyamine having from about 2 to about 20 nitrogen atoms and being selected from the group consisting of aliphatic saturated amines having the formula:

$$R-\underset{\underset{R'}{|}}{N}-(CH_2)_s\underset{\underset{H}{|}}{N}-(CH_2)_s\underset{\underset{R'}{|}}{N}-R$$

wherein R and R' independently are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals, wherein each s is the same or a different number of from 2 to 6, and wherein t is a number of from 0 to 10, with the provision that when t=O, at least one of R or R' must be H such that there are at least two of either primary or secondary amino groups, (b) polyoxyalkylene polyamines having the formula:

$$NH_2\text{-alkylene-(O-alkylene)}_m\text{-}NH_2 \qquad \text{(b) (i)}$$

where m has a value of about 3 to 70; or $R''$-[alkylene-(O-alkylene)$_n$-$NH_2$]$_a$ (b) (ii)

where n has a value of about 1 to 40 with the provision that the sum of all the n's is from about 3 to about 70, R'' is a polyvalent saturated hydrocarbon radical of up to ten carbon atoms, and a is a number from 3 to 6, (c) polyamines having the generalized formula:

$$NH_2—Z—NH_2,$$

wherein Z is selected from the group consisting of $—CH_2CH_2CH_2—$, $—(CH_2CH_2CH_2NH)_{n1}CH_2CH_2CH_2—$, where $n^1$ is 1 to 6, and $—(CH_2CH_2CH_2NH)_{m1}CH_2(CH_2)_p(NH—CH_2CH_2CH_2)_{m2}$, where $m^1$ and $M^2$ are each at least 1, $M^1 + M^2$ is from 2 to 5, p is from 1 to 4, and mixtures thereof, and said ester/alcohol friction modifier having been prepared by reacting at least one linear or branched, saturated or unsaturated aliphatic carboxylic acid having from about 7 to about 24 total carbon atoms with at least one polyhydric alcohol selected from the group consisting of aliphatic polyhydric alcohols containing from 3 to 15 carbon atoms and from 2 to about 10 hydroxyl groups, amino alcohols and mixtures thereof, wherein said blend provides an Equivalent Fuel Economy Improvement (EFEI) at least 2.7.

2. The blend of friction modifiers according to claim 1, wherein each of said amine/amide friction modifier and said ester/alcohol friction modifier are prepared from at least one acid containing from about 14 to about 20 total carbon atoms.

3. The blend of friction modifiers according to claim 2, wherein each of said amine/amide friction modifier and said ester/alcohol friction modifier are prepared from an acid selected from the group consisting of isostearic acid, oleic acid, linoleic acid, ricinoleic acid and mixtures thereof.

4. The blend of friction modifiers according to claim 1, wherein said polyamine is selected from the group consisting of 1, 2-diaminoethane; 1, 3-diaminopropane; 1, 4-diaminobutane; 1, 6-diaminohexane; diethylene triamine; triethylene tetramine; tetraethylene pentamine; 1, 2-propylene diamine; di-(1, 2-propylene)triamine; di-(1, 3-propylene) triamine; N, N-dimethyl-1, 3-diaminopropane; N, N-di-(2-aminoethyl) ethylene diamine; and N-dodecyl-1, 3-propane diamine.

5. The blend of friction modifiers according to claim 1, wherein said polyamine is a mixture of poly (ethyleneamines) averaging about 5 to about 7 nitrogen atoms per molecule.

6. The blend of friction modifiers according to claim 1, wherein said polyhydric alcohol is an aliphatic alcohol containing from 3 to 15 carbon atoms and at least 3 hydroxyl groups.

7. The blend of friction modifiers according to claim 6, wherein said polyhydric alcohol is a member selected from the group consisting of glycerol, erythritol, pentaerythritol, mannitol, sorbitol, 1,2,4-hexanetriol, and tetrahydroxy pentane.

8. The blend of friction modifiers according to claim 1, wherein said polyhydric alcohol comprises an amino alcohol.

9. The blend of friction modifiers according to claim 8, wherein said amino alcohol is a 2,2-disubstituted-2-amino-1-alkanol of the formula

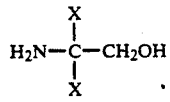

wherein X is alkyl or hydroxyalkyl group with the alkyl groups having from 1 to 3 carbon atoms, wherein at least one of the X substituents is a hydroxyalkyl group of the formula $(CH_2)_nOH$, and wherein n is 1 to 3.

10. The blend of friction modifiers according to claim 9, wherein said amino alcohol is tris (hydroxymethyl) amino methane.

11. An oleaginous composition comprising a major amount of oil of lubricating viscosity, from about 0.01 to about 2 wt. %, based on the total weight of said composition of an amine/amide friction modifier, and from about 0.1 to about 2 wt. % of an ester/alcohol friction modifier, said amine/amide friction modifier having been prepared by reacting at least one linear or branched, saturated or unsaturated aliphatic carboxylic acid having from about 7 to about 24 total carbon atoms with at least one polyamine having from about 2 to about 12 nitrogen atoms and being selected from the group consisting of (a) aliphatic saturated amines having the formula:

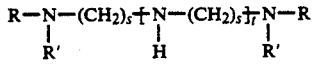

wherein R and R' independently are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals, wherein each s is the same or a different number of from 2 to 6, and wherein t is a number of from 0 to 10, with the provision that when t=O, at least one of R or R' must be H such that there are at least two of either primary or secondary amino groups, (b) polyoxyalkylene polyamines having the formula:

$NH_2$—alkylene—(O—alkylene)$_m$$NH_2$ (b) (i)

where m has a value of about 3 to 70; or $R''$-[alkylene-(O-alkylene)$_n$-$NH_2$]$_a$ (b) (ii)

where n has a value of about 1 to 40 with the provision that the sum of all the n's is from about 3 to about 70, R'' is a polyvalent saturated hydrocarbon radical of up to ten carbon atoms, and a is a number from 3 to 6, (c) polyamines having the generalized formula:

$$NH_2—Z—NH_2,$$

wherein Z is selected from the group consisting of $—CH_2CH_2CH_2—$, $—(CH_2CH_2CH_2NH)_{n1}CH_2CH_2CH_2—$, where $n^1$ is 1 to 6, and $—(CH_2CH_2CH_2NH)_{m1}CH_2(CH_2)_p(NH—CH_2CH_2CH_2)_{m2}$, where $m^1$ $m^2$ are each at least 1, $m^1 + m^2$ is from 2 to 5, p is from 1 to 4, and mixtures thereof, and said ester/alcohol friction modifier having been prepared by reacting at least one linear or branched, saturated or unsaturated aliphatic carboxylic acid having from about 7 to about 24 total carbon atoms with at least one polyhydric alcohol selected from the group consisting of aliphatic polyhydric alcohols containing from 3 to 15 carbon atoms and from 2 to about 10 hydroxyl groups, amino alcohols and mixtures thereof, wherein said blend provides an Equivalent Fuel Economy Improvement (EFEI) of at least 2.7.

12. A lubricating oil composition comprising a major amount of lubricating oil and about 0.02 to about 4 wt. % of the blend of friction modifiers according to claim 1.

13. A lubricating oil composition comprising a major amount of lubricating oil and about 0.02 to about 4 wt. % of the blend of friction modifiers according to claim 7.

14. A lubricating crankcase motor oil composition for automotive vehicles and trucks comprising a major amount of lubricating oil; from 0.01 to about 2 wt. %, based on the total weight of the composition, of an amine/amide friction modifier formed by reacting at least one linear or branched, saturated or unsaturated $C_7$ to $C_{24}$ aliphatic carboxylic acid with a polyamine containing from about 2 to about 12 nitrogen atoms and being selected from the group consisting of (a) aliphatic saturated amines having the formula:

$$R-\underset{\underset{R'}{|}}{N}-(CH_2)_s\underset{\underset{H}{|}}{N}-(CH_2)_s\underset{\underset{R'}{|}}{N}-R$$

wherein R and R' independently are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals, wherein each s is the same or a different number of from 2 to 6 , and wherein t is a number of from 0 to 10, with the provision that when t=O, at least one of R or R' must be H such that there are at least two of either primary or secondary amino groups, (b) polyoxyalkylene polyamines having the formula:

$$NH_2\text{—alkylene—(O—alkylene)}_m\text{—}NH_2 \qquad \text{(b) (i)}$$

where m has a value of about 3 to 70; or $$R''\text{-[alkylene-(O-alkylene)}_n\text{-}NH_2]_a \qquad \text{(b) (ii)}$$

where n has a value of about 1 to 40 with the provision that the sum of all the n's is from about 3 to about 70, R'' is a polyvalent saturated hydrocarbon radical of up to ten carbon atoms, and a is a number from 3 to 6, (c) polyamines having the generalized formula:

$$NH_2\text{—}Z\text{—}NH_2,$$

wherein Z is selected from the group consisting of $-CH_2CH_2CH_2-$, $-(CH_2CH_2CH_2NH)_{n1}CH_2CH_2CH_2-$, where $n^1$ is 1 to 6, and $-(CH_2CH_2CH_2NH)_{m1}CH_2(CH_2)_p(NH-CH_2CH_2CH_2)_{m2}$, where $m^1$ and $M^2$ are each at least 1, $m^1+m^2$ is from 2 to 5, p is from 1 to 4, and mixtures thereof, and said ester/alcohol friction modifier having been prepared by reacting at least one linear or branched, saturated or unsaturated aliphatic carboxylic acid having from about 7 to about 24 total carbon atoms with at least one polyhydric alcohol selected from the group consisting of aliphatic polyhydric alcohols containing from 3 to 15 carbon atoms and from 2 to about 10 hydroxyl groups, amino alcohols and mixtures thereof, wherein said blend provides an Equivalent Fuel Economy Improvement (EFEI) of at least 2.7.

15. The composition according to claim 14, wherein said polyamine is selected from the group consisting of 1, 2-diaminoethane; 1, 3-diaminopropane; 1, 4-diaminobutane; 1, 6-diaminohexane; diethylene triamine; triethylene tetramine; tetraethylene pentamine; 1, 2-propylene diamine; di-(1, 2-propylene) triamine; di-(1, 3-propylene) triamine; N, N-dimethyl-1, 3-diaminopropane; N, N-di-(2-aminoethyl) ethylene diamine; and N-dodecyl-1, 3-propane diamine.

16. The composition according to claim 14, wherein said polyamine is a mixture of poly (ethyleneamines) averaging about 5 to about 7 nitrogen atoms per molecule.

17. The composition according to claim 14, wherein said polyhydric alcohol is a member selected from the group consisting of glycerol, erythritol, pentaerythritol, mannitol, sorbitol, 1,2,4 - hexanetriol and tetrahydroxy pentane.

18. The composition according to claim 14, wherein said carboxylic acids used to prepare said amide/amine and said ester/alcohol friction modifiers contain from about 14 to about 20 carbon atoms.

19. A process for improving the fuel economy of a vehicle powered by an internal combustion engine having a crankcase, which comprises adding to said crankcase a lubricating motor oil composition according to claim 14.

20. A process for improving the fuel economy of a vehicle powered by an internal combustion engine having a crankcase, which comprises adding to said crankcase a lubricating motor oil composition according to claim 15.

21. A process for improving the fuel economy of a vehicle powered by an internal combustion engine having a crankcase, which comprises adding to said crankcase a lubricating motor oil composition according to claim 16.

22. A process for improving the fuel economy of a vehicle powered by an internal combustion engine having a crankcase, which comprises adding to said crankcase a lubricating motor oil composition according to claim 18.

23. A crankcase lubricating oil composition prepared by admixing a major amount of an oil of lubricating viscosity with a minor amount of a blend of friction modifier additives comprising at least one amine/amide friction modifier and at least one ester/alcohol friction modifier, said blend having a weight ratio of amine/amide: ester/alcohol of from 1:10 to about 10:1, said amide/amine friction modifier having been prepared by reacting at least one least linear or branched, saturated or unsaturated aliphatic carboxylic acid having from about 7 to about 24 total carbon atoms with at least one polyamine having from about 2 to about 20 nitrogen atoms and being selected from the group consisting of (a) aliphatic saturated amines having the formula:

$$R-\underset{\underset{R'}{|}}{N}-(CH_2)_s\underset{\underset{H}{|}}{N}-(CH_2)_s\underset{\underset{R'}{|}}{N}-R$$

wherein R and R' independently are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals, wherein each s is the same or a different number of from 2 to 6, and wherein t is a number of from 0 to 10, with the provision that when t=O, at least one of R or R' must be H such that there are at least two of either primary or secondary amino groups, (b) polyoxyalkylene polyamines having the formula:

$$NH_2\text{—alkylene—(O—alkylene)}_m\text{—}NH_2 \quad \text{(B) (i)}$$

where m has a value of about 3 to 70; or $$R''\text{-[alkylene-(O-alkylene)}_n\text{-}NH_2]_a \quad \text{(b) (ii)}$$

where n has a value of about 1 to 40 with the provision that the sum of all the n's is from about 3 to about 70, R'' is a polyvalent saturated hydrocarbon radical of up to ten carbon atoms, and a is a number from 3 to 6, (c) polymines having the generalized formula:

$$NH_2\text{—}Z\text{—}NH_2,$$

wherein Z is selected from the group consisting of $-CH_2CH_2CH_2-$, $-(CH_2CH_2CH_2NH)_{n1}CH_2CH_2CH_2-$, where $n^1$ is 1 to 6, and $-(CH_2CH_2CH_2NH)_{m1}CH_2(CH_2)_p(NH-CH_2CH_2CH_c)_{m2}$, where $m^1$ and $m^2$ are each at least 1, $m^1 + m^2$ is from 2 to 5, p is from 1 to 4, and mixtures thereof, and said ester/alcohol friction modifier having been prepared by reacting at least one linear or branched, saturated or unsaturated aliphatic carboxylic acid having from about 7 to about 24 total carbon atoms with at least one polyhydric alcohol selected from the group consisting of aliphatic polyhydric alcohols containing from 3 to 15 carbon atoms and from 2 to about 10 hydroxyl groups, amino alcohols and mixtures thereof.

24. The crankcase lubricating oil composition according to claim 23, wherein each of said amine/amide friction modifier and said ester/alcohol friction modifier are prepared from at least one acid containing from about 14 to about 20 total carbon atoms.

25. The crankcase lubricating oil composition according to claim 24, wherein each of said amine/amide friction modifiers and said ester/alcohol friction modifier are prepared from an acid selected from the group consisting of isostearic acid, oleic acid, linoleic acid, ricinoleic acid and mixtures thereof.

26. The crankcase lubricating oil composition according to claim 25, wherein said polyamine is selected from the group consisting of 1,2-diaminoethane; 1,3-diaminopropane; 1,4-diaminobutane; 1,6-diaminohexane; diethylene triamine; triethylene tetramine; tetraethylene pentamine; 1,2-propylene diamine; di-(1,2-propylene)-triamine; di-(1,3-propylene)triamine; N,N-dimethyl-1,3-diaminopropane; N,N-di-)2-aminoethyl)ethylene diamine; and N-dodecyl-1,3-propane diamine.

27. The crankcase lubricating oil composition according to claim 23, wherein said polyamine is a mixture of poly(ethyleneamines) averaging about 5 to about 7 nitrogen atoms per molecule.

28. The crankcase lubricating oil composition according to claim 23, wherein said polyhydric alcohol is a member selected from the group consisting of glycerol, erythritol, pentaerythritol, mannitol, sorbitol, 1,2,4-hexanetriol, and tetrahydroxy pentane.

29. The crankcase lubricating oil composition according to claim 23, wherein said polyhydric alcohol comprises an amino alcohol.

30. The crankcase lubricating oil composition according to claim 29, wherein said amino alcohol is a 2,2-disubstituted-2-amino-1-alkanol of the formula

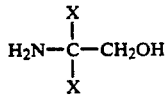

wherein X is alkyl or hydroxyalkyl group with the alkyl groups having from 1 to 3 carbon atoms, wherein at least one of the X substituents is a hydroxyalkyl group of the formula $(CH_2)_nOH$, and wherein n is 1 to 3.

31. The crankcase lubricating oil composition according to claim 30, wherein said amino alcohol is tris(hydroxymethyl) amino methane.

32. An oleaginous composition comprising a major amount of an oil of lubricating viscosity, from about 0.01 to about 2 wt. %, based on the total weight of said composition of an amine/amide friction modifier, and from about 0.01 to about 2 wt. % of an ester/alcohol friction modifier, said amine/amide friction modifier having been prepared by reacting at least one linear or branched, saturated or unsaturated aliphatic carboxylic acid having from about 7 to about 24 total carbon atoms with at least one polyamine having from about 2 to about 12 nitrogen atoms and being selected from the group consisting of (a) aliphatic saturated amines having the formula:

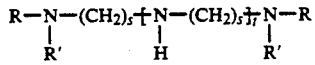

wherein R and R' independently are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals, wherein each s is the same or a different number of from 2 to 6, and wherein t is a number of from 0 to 10, with the provision that when t=O, at least one of R or R' must be H such that there are at least two of either primary or secondary amino groups, (b) polyoxyalkylene polyamines having the formula:

$$NH_2\text{—alkylene—(O—alkylene)}_m\text{—}NH_2 \quad \text{(b) (i)}$$

where m has a value of about 3 to 70; or $$R''\text{-[alkylene-(O-alkylene)}_n\text{-}NH_2]_a \quad \text{(b) (ii)}$$

where n has a value of about 1 to 40 with the provision that the sum of all the n's is from about 3 to about 70, R'' is a polyvalent saturated hydrocarbon radical of up to ten carbon atoms, and a is a number from 3 to 6, (c) polyamines having the generalized formula:

$$NH_2\text{—}Z\text{—}NH_2,$$

wherein Z is selected from the group consisting of $-CH_2CH_2CH_2-$, $-(CH_2CH_2CH_2NH)_{n1}CH_2CH_2CH_2-$, where $n^1$ is 1 to 6, and $-(CH_2CH_2CH_2NH)_{m1}CH_2(CH_2)_p(NH-CH_2CH_2CH_2)_{m2}$, where $m^1$ and $m^2$ are each at least 1, $m^1 + m^2$ is from 2 to 5, to p is from 1 to 4, and mixtures thereof, and said ester/alcohol friction modifier having been prepared by reacting at least one linear or branched, saturated or unsaturated aliphatic carboxylic acid having from about 7 to about 24 total carbon atoms with at least one polyhydric alcohol selected from the group consisting of aliphatic polyhydric alcohols containing from 3 to 15 carbon atoms and from 2 to about 10 hydroxyl groups, amino alcohols and mixtures thereof.

33. A lubricating crankcase motor oil composition for automotive vehicles and trucks comprising a major amount of lubricating oil; from 0.1 to about 2 wt. %, based on the total weight of the combination of an amine/amide friction modifier, and from about 0.1 to about 2 wt. % of an ester/alcohol friction modifier, said amine/amide friction modifier having been prepared by reacting at least one linear or branched, saturated or unsaturated $C_7$ $C_{24}$ aliphatic carboxylic acid with a polyamine containing from 2 to about 12 nitrogen atoms and being selected from the group consisting of (a) aliphatic saturated amines having $$R-\underset{\underset{R'}{|}}{N}-(CH_2)_s\underset{\underset{H}{|}}{N}-(CH_2)_s\underset{\underset{R'}{|}}{N}-R$$

wherein R and R' independently are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals, wherein each s is the same or different number of from 2 to 6, and wherein t is a number of from 0 to 10, with the provision that when t=O, at least one of R or R' must be H such that there are at least two of either primary or secondary amino groups, (b) polyoxyalkylene polyamines having the formula:

$$NH_2\text{—alkylene—(O—alkylene)}_m\text{—}NH_2 \qquad \text{(b) (i)}$$

where m has a value of about 3 to 70; or $$R''\text{-[alkylene-(O-alkylene)}_n\text{-}NH_2]_a \qquad \text{(b) (ii)}$$

where n has a value of about 1 to 40 with the provision that the sum of all the n's is from about 3 to about 70, R'' is a polyvalent saturated hydrocarbon radical of up to ten carbon atoms, and a is a number from 3 to 6, (c) polyamines having the generalized formula:

$$NH_2\text{—}Z\text{—}NH_2,$$

wherein Z is selected from the group consisting of $-CH_2CH_2CH_2-$, $-(CH_2CH_2CH_2NH)_{n1}CH_2CH_2CH_2-$, where $N^1$ is 1 to 6, and $-(CH_2CH_2CH_2NH)_{m1}CH_2(CH_2)_p(NH-CH_2CH_2CH_2)_{m2}$, where $m^1$ and $M^2$ are each at least 1, $m^1=m^2$ is from 2 to 5, p is from 1 to 4, and mixtures thereof, and said ester/alcohol friction modifier having been prepared by reacting at least one linear or branched, saturated or unsaturated aliphatic carboxylic acid having from about 7 to about 24 total carbon atoms with at least one polyhydric alcohol selected from the group consisting of aliphatic polyhydric alcohols containing from 3 to 15 carbon atoms and from 2 to about 10 hydroxyl groups, amino alcohols and mixtures thereof.

34. The composition according to claim 33, wherein said polyamine is selected from the group consisting of 1,2-diaminoethane; 1,3-diaminopropane; 1,4-diaminobutane; 1,6-diaminohexane; diethylene triamine; triethylene tetramine; tetraethylene pentamine; 1,2-proplene diamine; di-(1,2-propylene)triamine; di-(1,3-propylene)-triamine; N,N-dimethyl-1,3-diaminopropane; N,N-di-(2-aminoethyl)ethylene diamine; and N-dodecyl-1,3-propane diamine.

35. The composition according to claim 33, wherein said polyamine is a mixture of poly(ethyleneamines) averaging about 5 to about 7 nitrogen atoms per molecule.

36. The composition according to claim 33, wherein said polyhydric alcohol is a member selected from the group consisting of glycerol, erythritol, pentaerythritol, mannitol, sorbitol, 1,2,4-hexanetriol and tetrahydroxy pentane.

37. The composition according to claim 33, wherein said carboxylic acids are selected from the group consisting of isostearic acid, oleic acid, linoleic acid, ricinoleic acid and mixtures thereof.

38. The compositions according to claim 33, further comprising an effective amount of a dispersant additive and an effective amount of a viscosity modifier.

39. An additive concentrate comprising about 20 to about 80 wt. % lubricating oil and about 20 to about 80% of a blend of an amine/amide friction modifier and an ester/alcohol friction modifier, said blend having a weight ratio of amine/amide: ester/alcohol of from 1:10 to about 10:1, said amine/amide friction modifier having been prepared by reacting at least one linear or branched, saturated or unsaturated aliphatic carboxylic acid having from about 7 to about 24 total carbon atoms with at least one polyamine having from about 2 to about 12 nitrogen atoms and being selected from the group consisting of (a) aliphatic saturated amines having the formula:

$$R-\underset{\underset{R'}{|}}{N}-(CH_2)_s\underset{\underset{H}{|}}{N}-(CH_2)_s\underset{\underset{R'}{|}}{N}-R$$

wherein R and R' independently are selected from the group consisting of hydrogen, $C_1$ to $C_{25}$ straight or branched chain alkyl radicals, $C_1$ to $C_{12}$ alkoxy $C_2$ to $C_6$ alkylene radicals, and $C_1$ to $C_{12}$ alkylamino $C_2$ to $C_6$ alkylene radicals, wherein each s is the same or a different number of from 2 to 6, and wherein t is a number of from 0 to 10, with the provision that when t=O, at least one of R or R' must be H such that there are at least two of either primary or secondary amino groups, (b) polyoxyalkylene polyamines having the formula:

$$NH_2\text{—alkylene—(O—alkylene)}_m\text{—}NH_2 \qquad \text{(b) (i)}$$

where m has a value of about 3 to 70; or $$R''\text{-[alkylene-(O-alkylene)}_n\text{-}NH_2]_a \qquad \text{(b) (ii)}$$

where n has a value of about 1 to 40 with the provision that the sum of all the n's is from about 3 to about 70, R'' is a polyvalent saturated hydrocarbon radical of up to ten carbon atoms, and a is a number from 3 to 6, (c) polyamines having the generalized formula:

$$NH_2\text{—}Z\text{—}NH_2,$$

wherein Z is selected from the group consisting of $-CH_2CH_2CH_2-$, $-(CH_2CH_2CH_2NH)_{n1}CH_2CH_2CH_2-$, where $n^1$ is 1 to 6, and $-(CH_2CH_2CH_2NH)_{m1}CH_2(CH_2)_p(N-$ $H—CH_2CH_2CH_2)_{m2}$, where $m^1$ and $m^2$ are each at least 1, $m^1 = m^2$ is from 2 to 5, p is from 1 to 4, and mixtures thereof, and said ester/alcohol friction modifier having been prepared by reacting at least one linear or branched, saturated or unsaturated aliphatic carboxylic acid having from about 7 to about 24 total carbon atoms with at least one polyhydric alcohol selected from the group consisting of aliphatic polyhydric alcohols containing from 3 to 15 carbon atoms and from 2 to about 10 hydroxyl groups, amino alcohols and mixtures thereof.

40. The additive concentrate of claim 39, wherein said amine/amide friction modifier has been prepared from oleic acid and tetraethylene pentamine, and wherein said ester/alcohol friction modifier has been prepared from glycerine and an acid selected from the group consisting of oleic acid, ricinoleic acid or mixtures thereof.

41. The additive concentrate of claim 40, which also contains an effective amount of a dispersant.

42. A process for improving the fuel economy of a vehicle powered by an internal combustion engine having a crankcase, which comprises adding to said crankcase a lubricating motor oil composition according to claim 33.

43. A process for improving the fuel economy of a vehicle powered by an internal combustion engine having a crankcase, which comprises adding to said crankcase a lubricating motor oil composition according to claim 40.

* * * * *